US011407613B2

(12) United States Patent
Kattainen et al.

(10) Patent No.: US 11,407,613 B2
(45) Date of Patent: Aug. 9, 2022

(54) ELEVATOR COMMUNICATION SYSTEM

(71) Applicant: KONE Corporation, Helsinki (FI)

(72) Inventors: Ari Kattainen, Helsinki (FI); Juha-Matti Aitamurto, Helsinki (FI); Gergely Huszak, Helsinki (FI); Ferenc Staengler, Helsinki (FI)

(73) Assignee: KONE CORPORATION, Helsinki (FI)

( * ) Notice: Subject to any disclaimer, the term of this patent is extended or adjusted under 35 U.S.C. 154(b) by 0 days.

(21) Appl. No.: 17/467,873

(22) Filed: Sep. 7, 2021

(65) Prior Publication Data

US 2022/0119225 A1 Apr. 21, 2022

(30) Foreign Application Priority Data

Oct. 21, 2020 (EP) ..... 20203069

(51) Int. Cl.

| | |
|---|---|
| ***B66B 5/00*** | (2006.01) |
| ***B66B 1/30*** | (2006.01) |
| ***B66B 1/34*** | (2006.01) |
| ***B66B 5/02*** | (2006.01) |

(52) U.S. Cl.

CPC ..... *B66B 5/0031* (2013.01); *B66B 1/30* (2013.01); *B66B 1/3453* (2013.01); *B66B 5/02* (2013.01); *B66B 2201/40* (2013.01)

(58) Field of Classification Search

CPC ..... B66B 5/0031; B66B 1/30; B66B 1/3453; B66B 5/02; B66B 2201/40

See application file for complete search history.

(56) References Cited

U.S. PATENT DOCUMENTS

| | | | | |
|---|---|---|---|---|
| 5,854,454 | A * | 12/1998 | Upender | H04L 12/40163 340/7.53 |
| 6,062,343 | A * | 5/2000 | Wang | B66B 1/3415 187/247 |
| 6,173,814 | B1 * | 1/2001 | Herkel | B66B 1/34 187/248 |
| 7,350,624 | B2 * | 4/2008 | Deplazes | B66B 13/22 187/316 |

(Continued)

FOREIGN PATENT DOCUMENTS

| | | | |
|---|---|---|---|
| JP | 2002-538061 | A | 11/2002 |
| KR | 10-2013-0100723 | A | 9/2013 |
| WO | WO 03/020627 | A1 | 3/2003 |

OTHER PUBLICATIONS

Extended European Search Report, issued in Priority Application No. 20203069.8, dated Mar. 26, 2021.

(Continued)

*Primary Examiner* — Jeffrey Donels

(74) *Attorney, Agent, or Firm* — Birch, Stewart, Kolasch & Birch, LLP

(57) ABSTRACT

An elevator communication system includes at least one ethernet bus segment, a controller communicatively connected to the at least one ethernet bus segment, and a plurality of elevator system nodes communicatively connected to the at least one ethernet bus segment. The controller is configured to determine a fault situation in the elevator communication system and cause reduction of the data communication via the at least one ethernet bus segment based on the fault situation.

16 Claims, 8 Drawing Sheets

(56) References Cited

U.S. PATENT DOCUMENTS

| | | | | |
|---|---|---|---|---|
| 8,959,405 | B2 * | 2/2015 | Ikawa | B66B 1/34 714/704 |
| 9,452,909 | B2 * | 9/2016 | Taylor | B66B 5/0031 |
| 2004/0178024 | A1 * | 9/2004 | Deplazes | B66B 5/0031 187/394 |
| 2005/0082121 | A1 * | 4/2005 | Deplazes | B66B 5/0031 187/313 |
| 2019/0389694 | A1 * | 12/2019 | Herkel | B66B 5/005 |
| 2020/0031620 | A1 * | 1/2020 | Herkel | B66B 5/027 |
| 2020/0062539 | A1 * | 2/2020 | Carriero | H04L 65/1069 |

OTHER PUBLICATIONS

English translation of the Korean Office Action for Korean Application No. 10-2021-0120388, dated Dec. 15, 2021.

* cited by examiner

ELEVATOR COMMUNICATION SYSTEM

TECHNICAL FIELD

The present application relates to the field of elevator communication systems.

BACKGROUND

In modern elevator system, more and more data is sent and received by different entities of an elevator system. For example, an elevator controller may receive information from call buttons and then control an elevator drive to serve calls, or the elevator controller may receive information from a safety circuit and then based on this information control one or more entities of the elevator system. These are only some possible examples of situations where information is received and/or sent within an elevator system.

It is characteristic for the modern elevator systems that an elevator system may comprise multiple different internal data transmission solutions. This may mean that multiple different communication stacks and multiple different physical layers may be used simultaneously. The use of multiple different internal data transmission solutions may result in a complicated and inefficient solution.

Further, a redundant safety bus system may be implemented using, for example, a CAN protocol or with RS485 time triggered protocol (TTS). It has duplicated communication channels, both with the same structure and same data communicated. In this solution two parallel communication channels are needed for safety reasons. These techniques, however, cannot be used when an elevator communication system uses, for example, an ethernet bus based communication.

Thus, it would be beneficial to have a solution that would alleviate at least one of these drawbacks.

SUMMARY

According to a first aspect, there is provided an elevator communication system comprising at least one ethernet bus segment, a controller communicatively connected to the at least one ethernet bus segment and a plurality of elevator system nodes communicatively connected to the at least one ethernet bus segment. The controller is configured to determine a fault situation in the elevator communication system and cause reduction of the data communication via the at least one ethernet bus segment based on the fault situation.

In an implementation form of the first aspect, the reduction comprises reducing the amount of ethernet frames communicated via the at least one ethernet bus segment.

In an implementation form of the first aspect, the reduction comprises reducing the amount of ethernet frames communicated via the at least one ethernet bus segment based on a priority level associated with each ethernet frame.

In an implementation form of the first aspect, the controller is configured to switch off at least one of the plurality of elevator system nodes to cause the reduction of the data communication via the at least one ethernet bus segment.

In an implementation form of the first aspect, the controller is configured to associate communication in the elevator communication system into a plurality of communication profiles, and wherein the controller is configured to cause reduction of the communication via the at least one ethernet bus segment based on the communication profiles.

In an implementation form of the first aspect, the controller is configured to operate an elevator car with a limited speed in response to the determination.

In an implementation form of the first aspect, the controller is configured to operate an elevator car in a limited area in an elevator shaft in response to the determination.

In an implementation form of the first aspect, the elevator communication system comprises a parallel ethernet bus segment interlinked with the at least one ethernet bus segment and extending in parallel with the at least one ethernet bus segment, and wherein the controller is communicatively connected to the parallel ethernet bus segment.

In an implementation form of the first aspect, the at least one ethernet bus segment comprises at least one multi-drop ethernet segment.

In an implementation form of the first aspect, the at least one ethernet bus segment comprises at least one point-to-point ethernet segment.

In an implementation form of the first aspect, the controller comprises an elevator controller.

According to a second aspect, there is provided a method in an elevator communication system comprising at least one ethernet bus segment, a controller communicatively connected to the at least one ethernet bus segment, and a plurality of elevator system nodes communicatively connected to the at least one ethernet bus segment. The method comprises determining, by the controller, a fault situation in the elevator communication system, and causing, by the controller, reduction of the data communication via the at least one ethernet bus segment based on the fault situation.

In an implementation form of the second aspect, the reduction comprises reducing the amount of ethernet frames communicated via the at least one ethernet bus segment.

In an implementation form of the second aspect, the reduction comprises reducing the amount of ethernet frames communicated via the at least one ethernet bus segment based on a priority level associated with each ethernet frame.

In an implementation form of the second aspect, the method further comprises switching off, by the controller, at least one of the plurality of elevator system nodes to cause the reduction of the data communication via the at least one ethernet bus segment.

In an implementation form of the second aspect, the method further comprises associating, by the controller, communication in the elevator communication system into a plurality of communication profiles; and causing, by the controller, the reduction of the communication via the at least one ethernet bus segment with the communication profiles.

In an implementation form of the second aspect, the method further comprises operating, by the controller, an elevator car with a limited speed in response to the determination.

In an implementation form of the second aspect, the method further comprises operating, by the controller, an elevator car in a limited area in an elevator shaft in response to the determination.

According to a third aspect, there is provided a controller communicatively connected to at least one ethernet bus segment. The controller is configured to determine a fault situation in an elevator communication system comprising the least one ethernet bus segment, and a plurality of elevator system nodes communicatively connected to the at least one ethernet bus segment; and cause reduction of the data communication via at least one ethernet bus segment of the elevator communication system based on the fault situation.

In an implementation form of the third aspect, the reduction comprises reducing the amount of ethernet frames communicated via the at least one ethernet bus segment.

In an implementation form of the third aspect, the reduction comprises reducing the amount of ethernet frames communicated via the at least one ethernet bus segment based on a priority level associated with each ethernet frame.

In an implementation form of the third aspect, the controller is configured to switch off at least one of the plurality of elevator system nodes to cause the reduction of the data communication via the at least one ethernet bus segment.

In an implementation form of the third aspect, the controller is configured to associate communication in the elevator communication system into a plurality of communication profiles, and wherein the controller is configured to cause reduction of the communication via the at least one ethernet bus segment based on the communication profiles.

In an implementation form of the third aspect, the controller is configured to operate an elevator car with a limited speed in response to the determination.

In an implementation form of the third aspect, the controller is configured to operate an elevator car in a limited area in an elevator shaft in response to the determination.

In an implementation form of the third aspect, the elevator communication system comprises a parallel ethernet bus segment interlinked with the at least one ethernet bus segment and extending in parallel with the at least one ethernet bus segment; and wherein the controller is communicatively connected to the parallel ethernet bus segment.

In an implementation form of the third aspect, the at least one ethernet bus segment comprises at least one multi-drop ethernet segment.

In an implementation form of the third aspect, the at least one ethernet bus segment comprises at least one point-to-point ethernet segment.

In an implementation form of the third aspect, the controller comprises an elevator controller.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION

The following description illustrates an elevator communication system that comprises at least one ethernet bus segment, a controller communicatively connected to the at least one ethernet bus segment, and a plurality of elevator system nodes communicatively connected to the at least one ethernet bus segment. The controller may be directly connected to an ethernet bus segment. In another example embodiment, the controller may not have to be directly connected to the ethernet bus segment. Instead, it may be connected, for example, a switch, an additional ethernet bus segment etc. The controller is configured to determine a fault situation in the elevator communication system and cause reduction of the data communication via the at least one ethernet bus segment based on the fault situation. The illustrated solution may enable, for example, a solution with an improved reliability and availability of an all-ethernet elevator communication system. Further, elevator service does not have to be interrupted in case of a single failure in the elevator communication system.

Further, the term "communicatively connected" used herein may mean that an element may be directly connected to another element, node or bus or that it may be indirectly connected to the another element, node or bus via a connecting element, node or bus.

In an example embodiment, the various embodiments discussed below may be used in an elevator system comprising at least one elevator that is suitable and may be used for transferring passengers between landing floors of a building in response to service requests. In another example embodiment, the various embodiments discussed below may be used in an elevator system comprising at least one elevator that is suitable and may be used for automated transferring of passengers between landings in response to service requests.

Figure 1A:
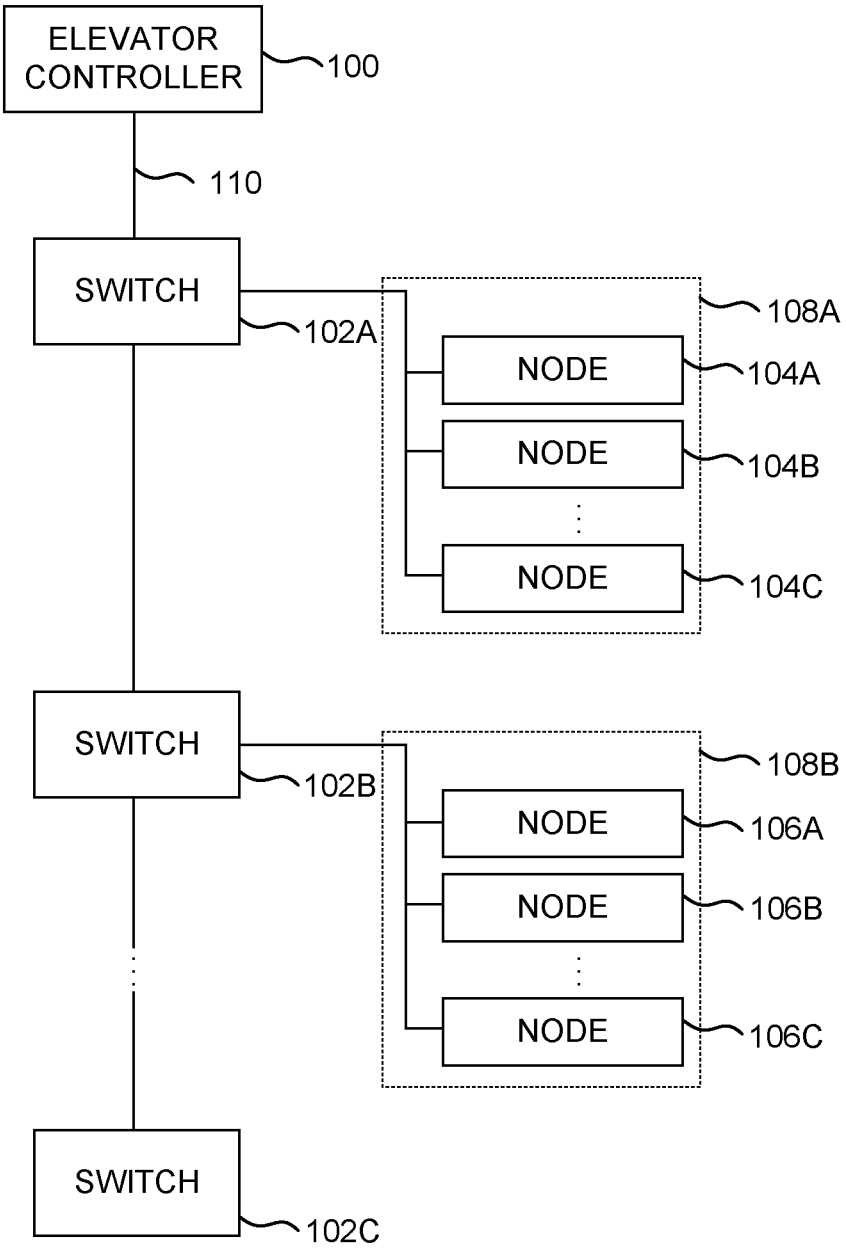
FIG. 1A illustrates an elevator communication system according to an example embodiment.

FIG. 1A illustrates an elevator communication system according to an example embodiment. The elevator communication system comprises a controller 100, for example, an elevator controller 100. The elevator communication system may further comprise one or more multi-drop ethernet bus segments 108A, 108B (for example, in the form of 10BASE-T1S) reachable by the elevator controller 100, and a plurality of elevator system nodes 104A, 104B, 104C, 106A, 106B, 106C coupled to the multi-drop ethernet bus segments 108A, 108B and configured to communicate via the multi-drop ethernet bus 108A, 108B. The elevator controller 100 is reachable by the elevator system nodes 104A, 104B, 104C, 106A, 106B, 106C via the multi-drop ethernet bus segments 108A, 108B. Elevator system nodes that are coupled to the same multi-drop ethernet bus segment may be configured so that one elevator system node is to be active at a time while the other elevator system nodes of the same multi-drop ethernet bus segment are in a high-impedance state.

In an example embodiment, the elevator communication system may comprise a point-to-point ethernet bus 110 and at least one connecting unit 102A, 102B, 102C comprising a first port connected to the respective multi-drop ethernet bus segments 108A, 108B and a second port connected to the point-to-point ethernet bus 110. Thus, by using the connecting units 102A, 102B, 102C, one or more multi-drop ethernet bus segments 108A, 108B may be connected to the point-to-point ethernet bus 110. The connecting unit 102A, 102B, 102C may refer, for example, to a switch. Further, the point-to-point ethernet bus 110 may be connected to the elevator controller 100. The point-to-point ethernet bus 110 may be, for example, 100BASE-TX or 10BASET1L point-to-point ethernet bus. The multi-drop ethernet bus segment 108A, 108B may comprise, for example, 10BASE-T1S multi-drop ethernet bus.

In an example embodiment, an elevator system node 104A, 104B, 104C, 106A, 106B, 106C may be configured to interface with at least one of an elevator fixture, an elevator sensor, an elevator safety device, and an elevator control device. Further, in an example embodiment, power to the nodes may be provided with the same cabling. In another example embodiment, the elevator system nodes 104A, 104B, 104C, 106A, 106B, 106C may comprise shaft nodes, and a plurality of shaft node may form a shaft segment, for example, the multi-drop ethernet bus segment 108A, 108B.

Figure 1B:
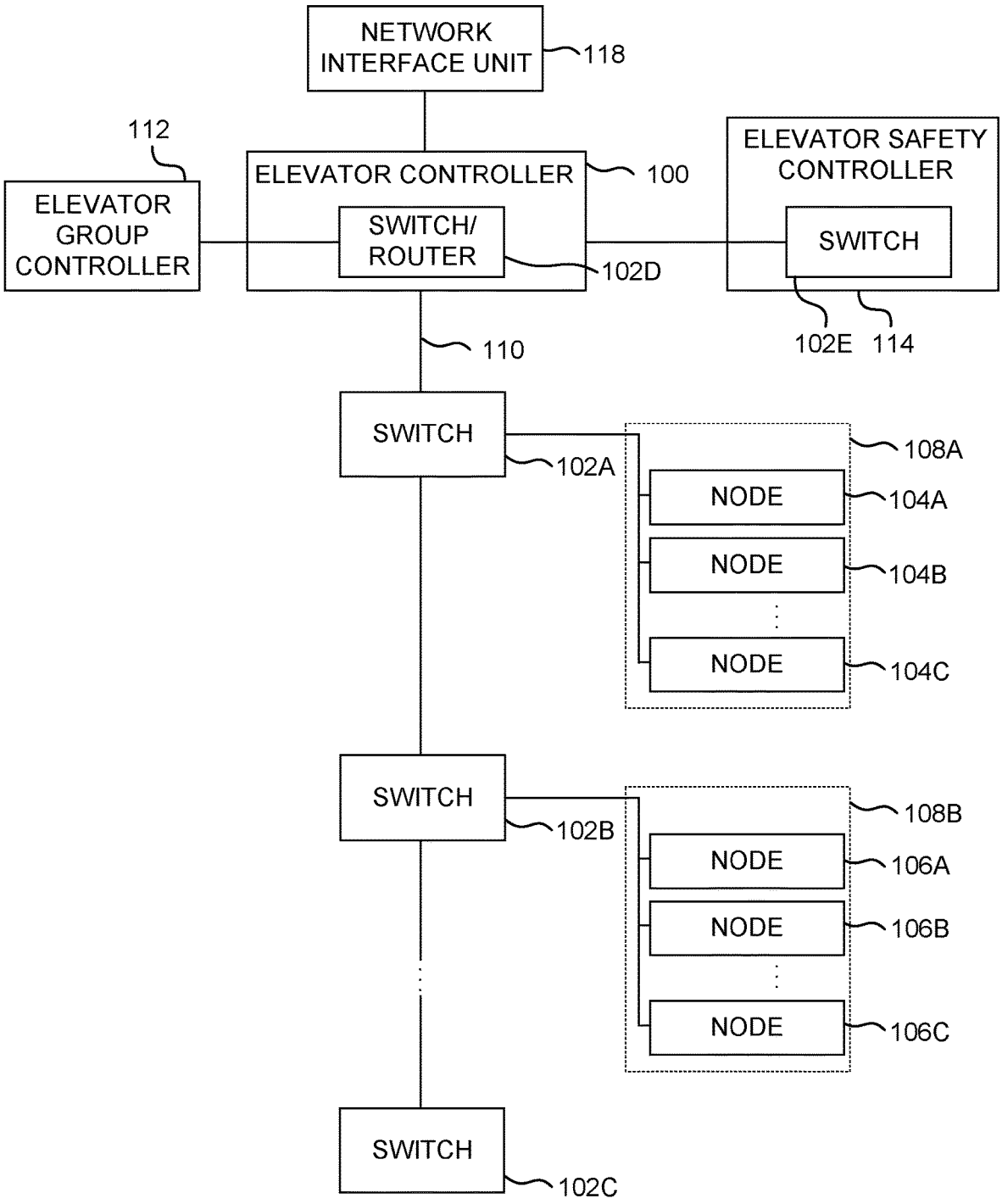
FIG. 1B illustrates an elevator communication system according to another example embodiment.

FIG. 1B illustrates an elevator communication system according to another example embodiment. The elevator communication system comprises a controller 100, for example, an elevator controller 100. The elevator communication system may further comprise one or more multi-drop ethernet bus segments 108A, 108B reachable by the elevator controller 100, and a plurality of elevator system nodes 104A, 104B, 104C, 106A, 106B, 106C configured to communicate via the multi-drop ethernet bus segments 108A, 108B, wherein the elevator controller 100 is reachable by the elevator system nodes 104A, 104B, 104C via the multi-drop ethernet bus segments 108A, 108B. The elevator communication system may also comprise an elevator group controller 112 connected to the elevator controller 100. The elevator controller 100 may comprise a switch or a router 102D, which connects the elevator controller 100 to an internal ethernet network of the elevator communication system.

In an example embodiment, the elevator communication system may comprise a point-to-point ethernet bus 110 and at least one connecting unit 102A, 102B, 102C comprising a first port connected to the respective multi-drop ethernet bus segment 108A, 108B and a second port connected to the point-to-point ethernet bus 110. Thus, by using the connecting units 102A, 102B, 102C, one or more multi-drop ethernet bus segments 108A, 108B may be connected to the point-to-point ethernet bus 110. The connecting unit 102A, 102B, 102C may refer, for example, to a switch, a hub or a router. Further, the point-to-point ethernet bus 110 may be connected to the elevator controller 100. The point-to-point ethernet bus 110 may be, for example, 100BASE-TX or 10BASET1L point-to-point ethernet bus. The multi-drop ethernet bus segment 108A, 108B may comprise, for example, 10BASE-T1S multi-drop ethernet bus.

In an example embodiment, an elevator system node 104A, 104B, 104C, 106A, 106B, 106C may be configured to interface with at least one of an elevator fixture, an elevator sensor, an elevator safety device, and an elevator control device. Further, in an example embodiment, power to the nodes may be provided with the same cabling. In another example embodiment, the elevator system nodes 104A, 104B, 104C, 106A, 106B, 106C may comprise shaft nodes, and a plurality of shaft node may form a shaft segment, for example, the multi-drop ethernet bus segment 108A, 108B.

The elevator communication system may comprise an elevator safety controller 114. The elevator safety controller 114 may be connected to the point-to-point ethernet bus 110 via a connecting unit 102E. This means that the elevator system nodes 104A, 104B, 104C, 106A, 106B, 106C may send information to the elevator safety controller 114 and vice versa via the common point-to-point ethernet bus 110. For example, the elevator system nodes 104A, 104B, 104C, 106A, 106B, 106C may send information from sensors or fixtures to the elevator controller 100 or the elevator safety controller 114 and receive information therefrom to control, for example, actuators configure fixtures etc. At least some of the elevator system nodes 104A, 104B, 104C, 106A, 106B, 106C may be safety nodes in accordance with IEC61508 SIL level 3, having a safety processing unit and a separate communication controller. Data of the safety processing unit may be sent only to the elevator safety controller 114. The safety nodes may be configured to interface with elevator safety devices, such as safety sensors or safety contacts indicating elevator safety, e.g. landing door contacts, door lock contacts, contact of overspeed governor, buffer contacts etc. The safety nodes may be configured to communicate with the elevator safety controller 114. To establish safe communication, different kind of data checks, such as checksums, error detection and/or correction algorithms etc. may be used in the communication.

Figure 1C:
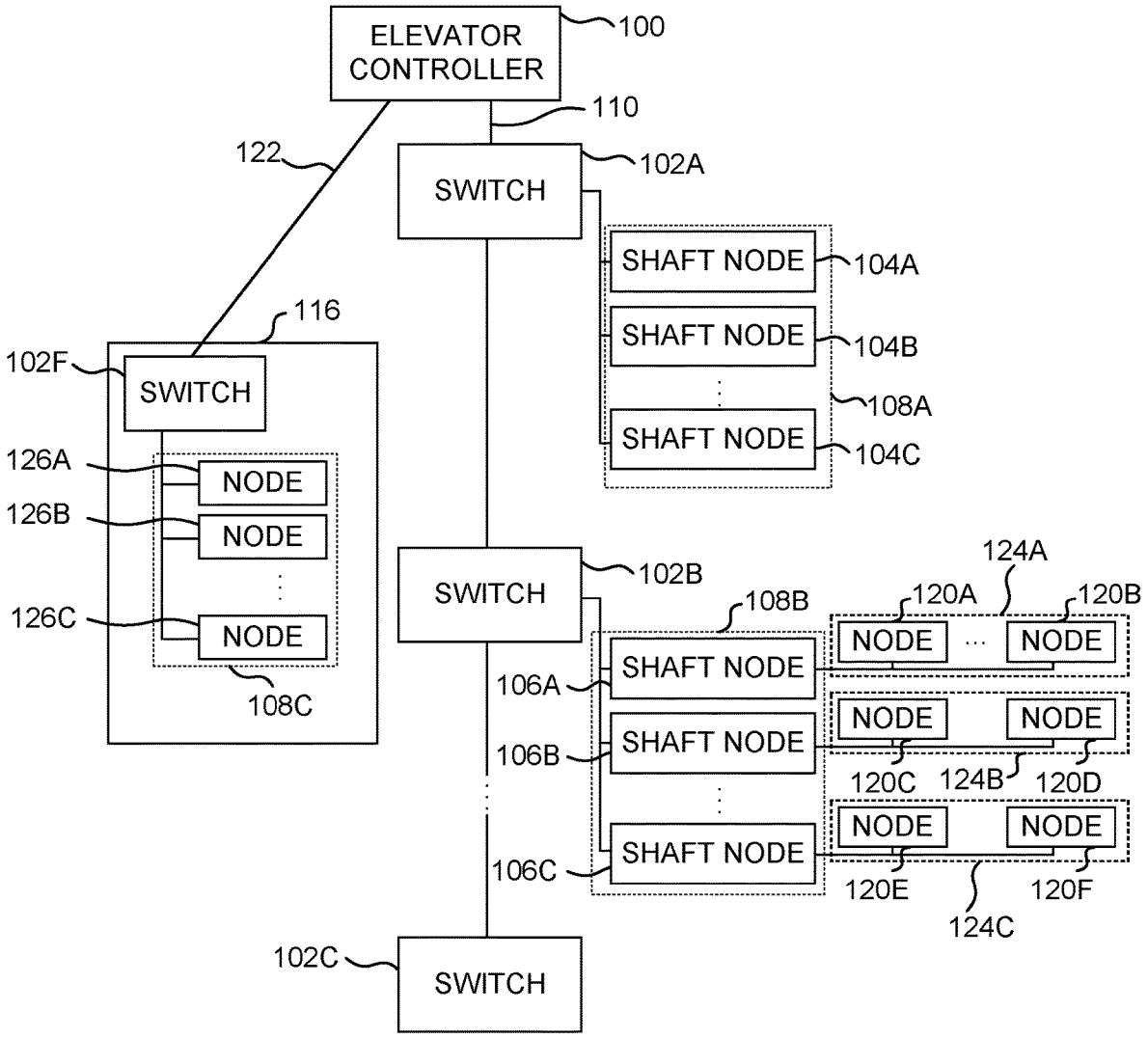
FIG. 1C illustrates an elevator communication system according to another example embodiment.

FIG. 1C illustrates an elevator communication system according to another example embodiment. The elevator communication system comprises an elevator controller 100. The elevator communication system may further comprise one or more multi-drop ethernet bus segments 108A, 108B, 108C, 124A, 124B, 124C reachable by the elevator controller 100, and a plurality of elevator system nodes 104A, 104B, 104C, 106A, 106B, 106C, 120A-120F, 124A, 124B, 124C, 126A, 126B, 126C configured to communicate via the multi-drop ethernet bus segments 108A, 108B, 108C, 124A, 124B, 124C, wherein the elevator controller 100 is reachable by the elevator system nodes 104A, 104B, 104C, 106A, 106B, 106C, 120A, 120F, 124A, 124B, 124C, 126A, 126B, 126C via the multi-drop ethernet bus segments 108A, 108B, 108C, 124A, 124B, 124C.

In an example embodiment, the elevator communication system may comprise a point-to-point ethernet bus 110 and at least one connecting unit 102A, 102B comprising a first port connected to the multi-drop ethernet bus segment 108A, 108B and a second port connected to the point-to-point ethernet bus 110. Thus, by using the connecting units 102A, 102B one or more multi-drop ethernet bus segments 108A, 108B may be connected to the point-to-point ethernet bus 110. The connecting unit 102A, 102B may refer, for example, to a switch, a hub or a router. Further, the point-to-point ethernet bus 110 may be connected to the elevator controller 100. The point-to-point ethernet bus 110 may be, for example, 100BASE-TX or 10BASET1L point-to-point ethernet bus. The multi-drop ethernet bus segments 108A, 108B may comprise, for example, 10BASE-T1S multi-drop ethernet bus.

In an example embodiment, an elevator system node 120A-120F, 126A, 126B, 126C is configured to interface with at least one of an elevator fixture, an elevator sensor, an elevator safety device, and an elevator control device. Further, in an example embodiment, power to the nodes may be provided with the same cabling.

The elevator communication system may comprise an elevator safety controller. The elevator safety controller may be connected to the point-to-point ethernet bus 110 via a connecting unit. This means that the elevator system nodes 104A, 104B, 104C, 106A, 106B, 106C, 120A-120F, 126A, 126B, 126C may send information to the elevator safety controller and vice versa via the common point-to-point ethernet bus 110. For example, the elevator system nodes 104A, 104B, 104C, 106A, 106B, 106C, 120A-120F, 126A, 126B, 126C may send information, for example, from sensors or fixtures to the elevator controller 100 or the elevator safety controller 114 and receive information therefrom to control, for example, actuators configure fixtures etc. At least some of the elevator system nodes 104A, 104B, 104C, 106A, 106B, 106C, 120A-120F, 126A, 126B, 126C may be safety nodes in accordance with IEC61508 SIL level 3, having a safety processing unit and a separate communication controller. Data of the safety processing unit may be sent only to the elevator safety controller 114. The safety nodes may be configured to interface with elevator safety devices, such as safety sensors or safety contacts indicating elevator safety, e.g. landing door contacts, door lock contacts, contact of overspeed governor, buffer contacts etc. The safety nodes may be configured to communicate with the elevator safety controller 114. To establish safe communication, different kind of data checks, such as checksums, error detection and/or correction algorithms etc. may be used in the communication.

The elevator communication system may further comprise an elevator drive connected to the elevator controller 100. Further, the elevator communication system may comprise a network interface unit communicatively connected to the elevator controller 100, the network interface unit enabling a connection to an external communication network. The network interface unit may comprise, for example, a router or a gateway.

The elevator communication system may further comprise a point-to-point ethernet bus 122 that provides a connection to an elevator car 116 and to various elements associated with the elevator car 116. The elevator car 116 may comprise a connecting unit 102F, for example, a switch, to which one or more elevator car nodes 126A, 126B, 126C may be connected. In an example embodiment, the elevator car nodes 126A, 126B, 126C can be connected to the connecting unit 102F via a multi-drop ethernet bus segment 108C, thus constituting an elevator car segment. In an example embodiment, the point-to-point-ethernet bus 122 is located in the travelling cable of the elevator car 116.

By implementing communication within the elevator communication system using at least one point-to-point ethernet bus and at least one multi-drop ethernet bus segment, various segments can be formed within the elevator communication system. For example, the elevator system nodes 120A, 120B may form a first landing segment, the elevator system nodes 120C, 120D may form a second landing segment, the elevator system nodes 120D, 120F may form a third landing segment, the shaft nodes 104A, 104B, 104C may form a first shaft segment, the shaft nodes 106A, 106B, 106C may form a second shaft segment, the elevator car nodes 126A, 126B, 126C may form an elevator car segment 108C, and the elevator drive may form a machinery segment. Each of the segments 108A, 108B, 108C implemented using separate multi-drop ethernet buses.

As illustrated in FIG. 1C, the shaft nodes 106A, 106B, 106C may interconnect the shaft segment 108B to which the shaft nodes 106A, 106B, 106C are connected to and the landing segments 124A, 124B, 124C. In other words, the shaft nodes 106A, 106B, 106C may comprise or may act as a switch to the landing segments 124A, 124B, 124C. This may enable a simple solution for adding new elevator system nodes to the elevator communication system. This may also enable a solution in which a single elevator system node may act as a switch or a repeater to another multi-drop ethernet bus segment to which nearby elevator system elements, for example, a call button or buttons, a display or displays, a destination operating panel or panels, a camera or cameras, a voice intercom device etc.

The elevator communication system may further comprise a network analyzer configured to analyze bus traffic, the network analyzer being communicatively connected to the elevator controller.

Figure 1D:
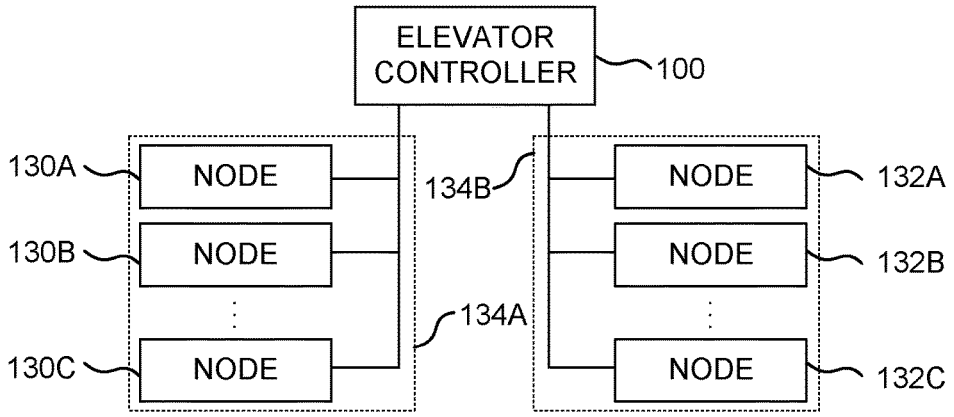
FIG. 1D illustrates an elevator communication system according to another example embodiment.

FIG. 1D illustrates an elevator communication system according to another example embodiment.

The elevator communication system comprises a controller 100, for example, an elevator controller 100. The elevator communication system may further comprise a first multi-drop ethernet bus segment 134A (for example, in the form of 10BASE-T1S) reachable by the elevator controller 100, and a second multi-drop ethernet bus segment 134B (for example, in the form of 10BASE-T1S) reachable by the elevator controller 100. A first set of elevator system nodes 130A, 130B, 130C may be configured to communicate via the first multi-drop ethernet bus segment 134A and a second set of elevator system nodes 132A, 132B, 132C may be configured to communicate via the second multi-drop ethernet bus segment 134B. The first multi-drop ethernet bus segment 134A may be reachable via a first port associated with the elevator controller 100 and the second multi-drop ethernet bus segment 134B may be reachable via a second port associated with the elevator controller 100. Elevator system nodes that are coupled to the same multi-drop ethernet bus segment may be configured so that one elevator system node is to be active at a time while the other elevator system nodes of the same multi-drop ethernet bus segment are in a high-impedance state.

In an example embodiment, an elevator system node 130A, 130B, 130C, 132A, 132B, 132C may be configured to interface with at least one of an elevator fixture, an elevator sensor, an elevator safety device, and an elevator control device. Further, in an example embodiment, power to the nodes may be provided with the same cabling.

In an example embodiment, the first multi-drop ethernet bus segment 134A may be a car segment and the second multi-drop ethernet segment 134B may be a shaft segment. In other example embodiments, each multi-drop ethernet bus segment may be configured to cover a separate functional segment of the elevator system, and the separate functional segment may comprise, for example, one of a machinery segment, a shaft segment, a landing segment, and a car segment. Further, even though FIG. 1D illustrates only two multi-drop ethernet segments 134A, 134B reachable by the elevator controller 100, in other embodiments, there may be more than two multi-drop ethernet bus segments in the elevator communication system.

Figure 1E:
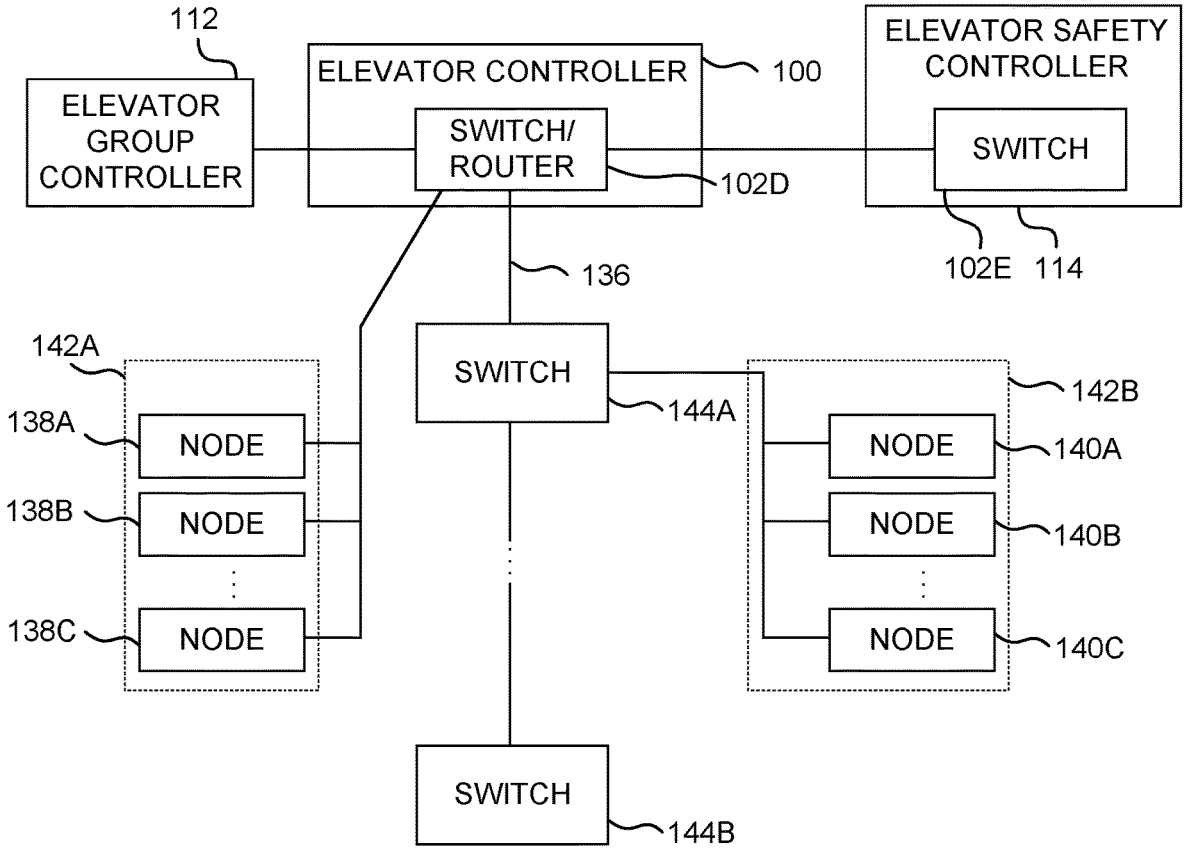
FIG. 1E illustrates an elevator communication system according to another example embodiment.

FIG. 1E illustrates an elevator communication system according to another example embodiment. The elevator communication system comprises a controller 100, for example, an elevator controller 100. The elevator communication system may further comprise one or more multi-drop ethernet bus segments 142A, 142B reachable by the elevator controller 100, and a plurality of elevator system nodes 138A, 138B, 138C, 140A, 140B, 140C configured to communicate via the multi-drop ethernet bus segments 142A, 142B, wherein the elevator controller 100 is reachable by the elevator system nodes 138A, 138B, 138C, 140A, 140B, 140C via the multi-drop ethernet bus segments 142A, 142B. The elevator communication system may also comprise an elevator group controller 112 connected to the elevator controller 100. The elevator controller 100 may comprise a switch or a router 102D, which connects the elevator controller 100 to an internal ethernet network of the elevator communication system.

In an example embodiment, the elevator communication system may comprise a point-to-point ethernet bus 136 and at least one connecting unit 144A, 144B comprising a first port connected to the multi-drop ethernet bus segment 142B and a second port connected to the point-to-point ethernet bus 110. Thus, by using the connecting units 144A, 144B, one or more multi-drop ethernet bus segments 142B may be connected to the point-to-point ethernet bus 110. The connecting unit 144A, 144B may refer, for example, to a switch, a hub or a router. Further, the point-to-point ethernet bus 136 may be connected to the elevator controller 100. The point-to-point ethernet bus 136 may be, for example, 100BASE-TX or 10BASET1L point-to-point ethernet bus. The multi-drop ethernet bus segment 142A, 142B may comprise, for example, 10BASE-T1S multi-drop ethernet bus.

One or more multi-drop ethernet bus segments may be connected directly to the elevator controller 100. FIG. 1E illustrates an example in which only one multi-drop ethernet bus segment 142B is connected to the elevator controller 100 via the switch 144A.

In an example embodiment, the elevator system nodes 138A, 138B, 138C, 140A, 140B, 140C may be configured to interface with at least one of an elevator fixture, an elevator sensor, an elevator safety device, and an elevator control device. Further, in an example embodiment, power to the nodes may be provided with the same cabling. In another example embodiment, the elevator system nodes 140A, 140B, 140C may be shaft nodes, and they may form a shaft segment 142B.

The elevator communication system may comprise an elevator safety controller 114. The elevator safety controller 114 may be connected to the point-to-point ethernet bus 136 and to the multi-drop ethernet bus segment 142A, 142B via a connecting unit 102E. This means that the elevator system nodes the elevator system nodes 138A, 138B, 138C, 140A, 140B, 140C may send information to the elevator safety controller 114 and vice versa via the common point-to-point ethernet bus 136 and the multi-drop ethernet bus segment 142A. For example, the elevator system nodes 138A, 138B, 138C, 140A, 140B, 140C may send information from sensors or fixtures to the elevator controller 100 or the elevator safety controller 114 and receive information therefrom to control, for example, actuators configure fixtures etc. At least some of the elevator system nodes 138A, 138B, 138C, 140A, 140B, 140C may be safety nodes in accordance with IEC61508 SIL level 3, having a safety processing unit and a separate communication controller. Data of the safety processing unit may be sent only to the elevator safety controller 114. The safety nodes may be configured to interface with elevator safety devices, such as safety sensors or safety contacts indicating elevator safety, e.g. landing door contacts, door lock contacts, contact of overspeed governor, buffer contacts etc. The safety nodes may be configured to communicate with the elevator safety controller 114. To establish safe communication, different kind of data checks, such as checksums, error detection and/or correction algorithms etc. may be used in the communication.

Figure 1F:
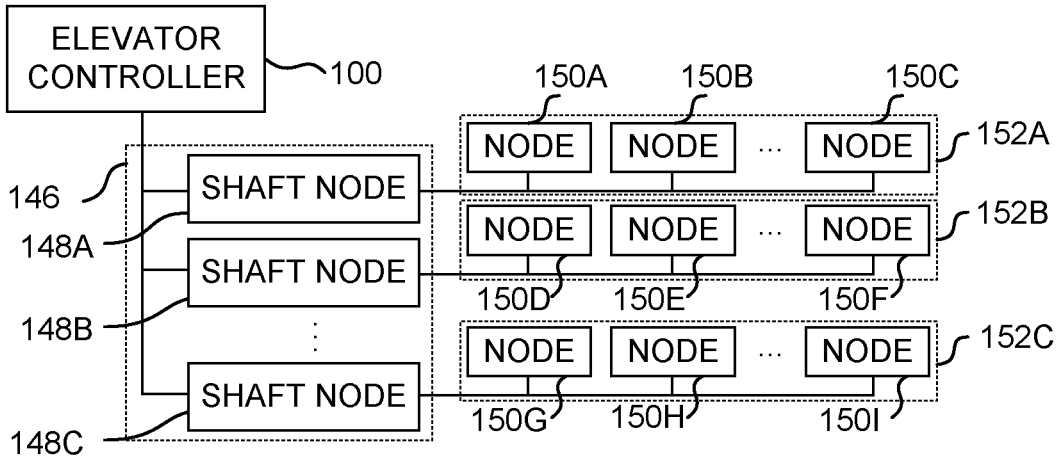
FIG. 1F illustrates an elevator communication system according to another example embodiment.

FIG. 1F illustrates an elevator communication system according to another example embodiment. The elevator communication system comprises a controller 100, for example, an elevator controller 100. The elevator communication system may further comprise a multi-drop ethernet bus segment 146 (for example, in the form of 10BASE-T1S) forming a shaft segment reachable by the elevator controller 100. The multi-drop ethernet bus segment 146, i.e. a shaft segment, may comprise shaft nodes 148A, 148B, 148C configured to communicate via the multi-drop ethernet bus segment 146A.

Elevator system nodes 150A, 150B, 150C, i.e. landing nodes, are connected to a multi-drop ethernet bus segment 152A, i.e. to a landing segment. Similarly, elevator system nodes 150D, 150E, 150F are connected to a multi-drop ethernet bus segment 152B, and elevator system nodes 150G, 150H, 150I are connected to a multi-drop ethernet bus segment 152C. The shaft nodes 148A, 148B, 148C may be configured to act as a switch or a hub, enabling communication between the shaft segment 146 and the respective landing segments 152A, 152B, 152C. Landing nodes that are coupled to the same multi-drop ethernet bus segment may be configured so that one landing node is to be active at a time while the other landing nodes of the same multi-drop ethernet bus segment are in a high-impedance state.

In an example embodiment, the landing node 150A, 150B, 150C, 150D, 150E, 150F, 150G, 150H, 150I may be configured to interface with at least one of an elevator fixture, an elevator sensor, an elevator safety device, and an elevator control device. Further, in an example embodiment, power to the nodes may be provided with the same cabling.

Figure 1G:
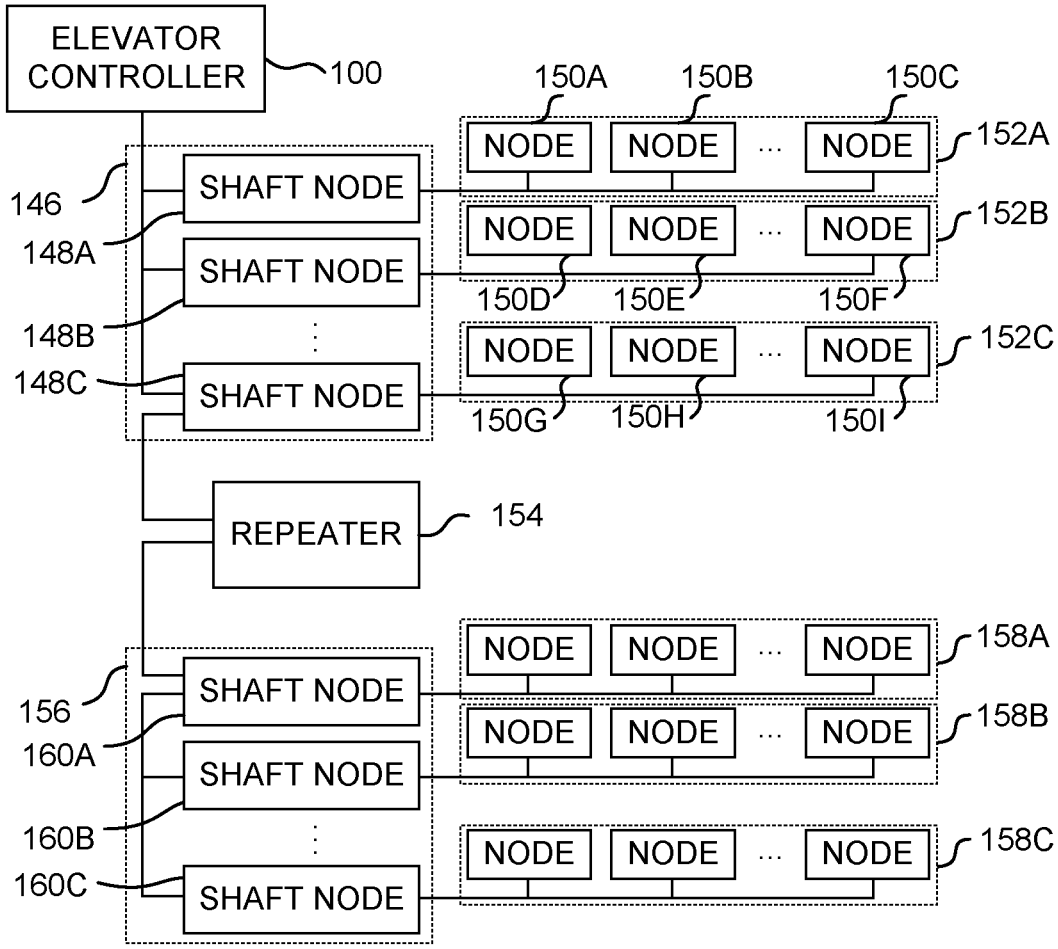
FIG. 1G illustrates an elevator communication system according to another example embodiment.

FIG. 1G illustrates an elevator communication system according to another example embodiment. The embodiment illustrated in FIG. 1G comprises all the elements discussed in relation to FIG. 1E. Additionally, FIG. 1G illustrates a repeater 152 that connects another shaft segment 156 to the shaft segment 146. As illustrated in FIG. 1G, multiple landing segments 158A, 158B, 158C are connected to the shaft nodes 160A, 160B, 160C similarly than was discussed above in relation to FIG. 1F. By using one more repeaters, the physical reach of the multi-drop ethernet bus segments 146, 156 can be extended.

Figure 1H:
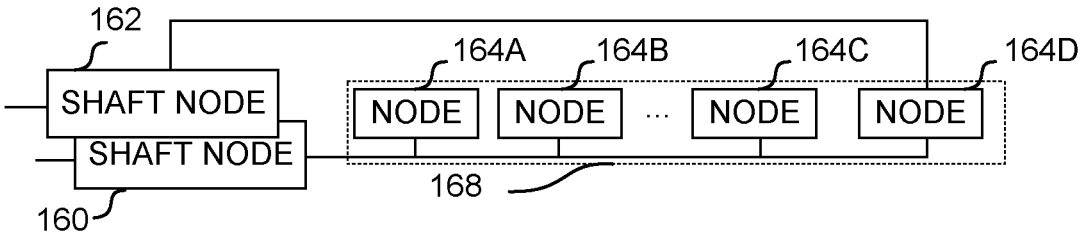
FIG. 1H illustrates a portion of an elevator communication system according to another example embodiment.

FIG. 1H illustrates a portion of an elevator communication system according to another example embodiment. The elevator communication system comprises a shaft node 160 that may be connected to a point-to-point ethernet bus or to a multi-drop ethernet bus as has already been discussed above. A landing segment 168, i.e. a multi-drop ethernet bus segment, is connected to the shaft node 160. The landing segment 168 comprises also a node 164D that can further be connected to a duplicated shaft node 162. This way, for example, a connection error of a landing node 164A, 164B, 164C may be identified and communication may be continued even in case of such a connection error.

Figure 1I:
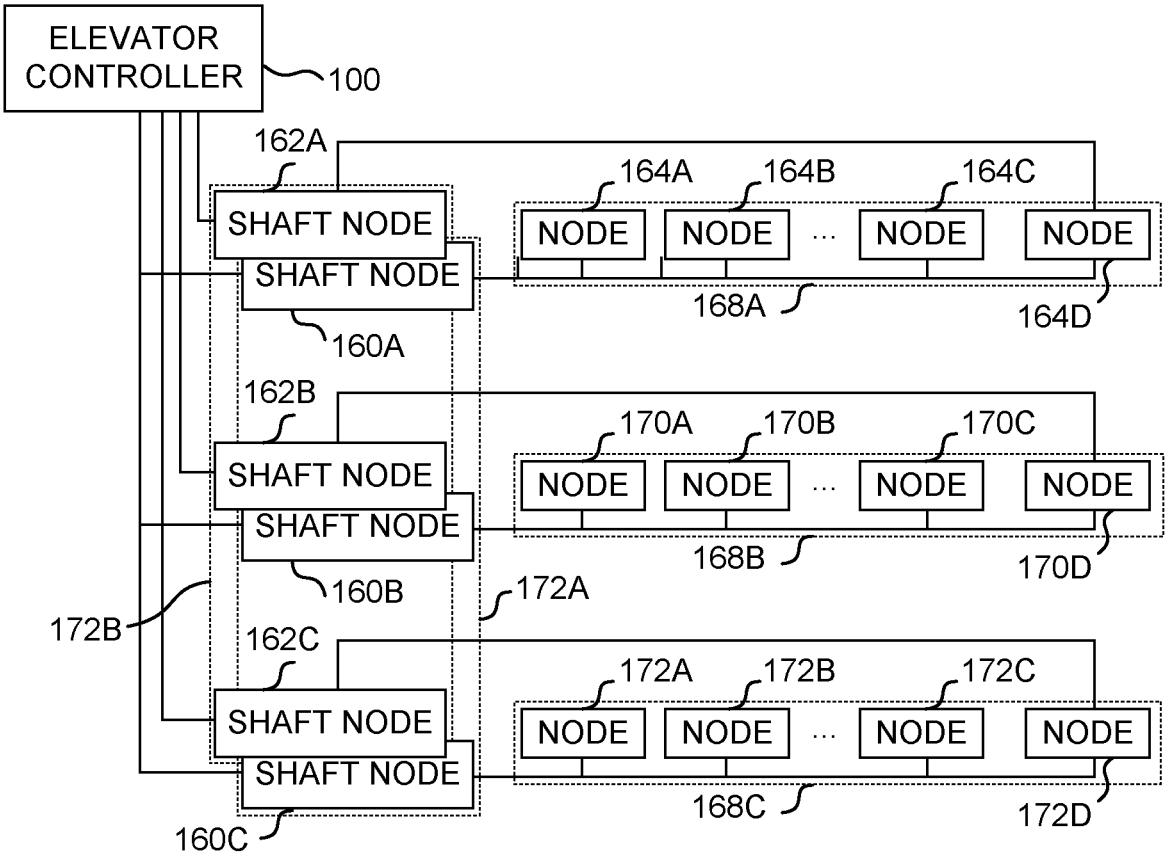
FIG. 1I illustrates a portion of an elevator communication system according to another example embodiment.

FIG. 1I illustrates a portion of an elevator communication system according to another example embodiment. Compared to the embodiment of FIG. 1H, in FIG. 1I also the shaft segment has been duplicated.

The elevator communication system comprises shaft nodes 160A, 106B, 106C that may be connected to a point-to-point ethernet bus or to a multi-drop ethernet bus as has already been discussed above. Landing segments 168A, 168B, 168C, i.e. multi-drop ethernet bus segments, are connected to the respective shaft nodes 160A, 160B, 160C. The landing segments 168A, 168B, 168C comprise also nodes 164D, 170D, 172D that can further be connected to duplicated shaft nodes 162A, 162B, 162C, and the connections from the shaft nodes 162A, 162B, 162C to the elevator controller 100 may be separate from the connections from the shaft nodes 160A, 106B, 160C to the elevator controller 100. This way, for example, a connection error of a landing node 164A-164D, 170A-170D, 172A-172D may be identified and communication may be continued even in case of such a connection error. This means that communication via the shaft bus, i.e. the multi-drop ethernet bus segment, is still possible even if one shaft segment fails.

Figure 1J:
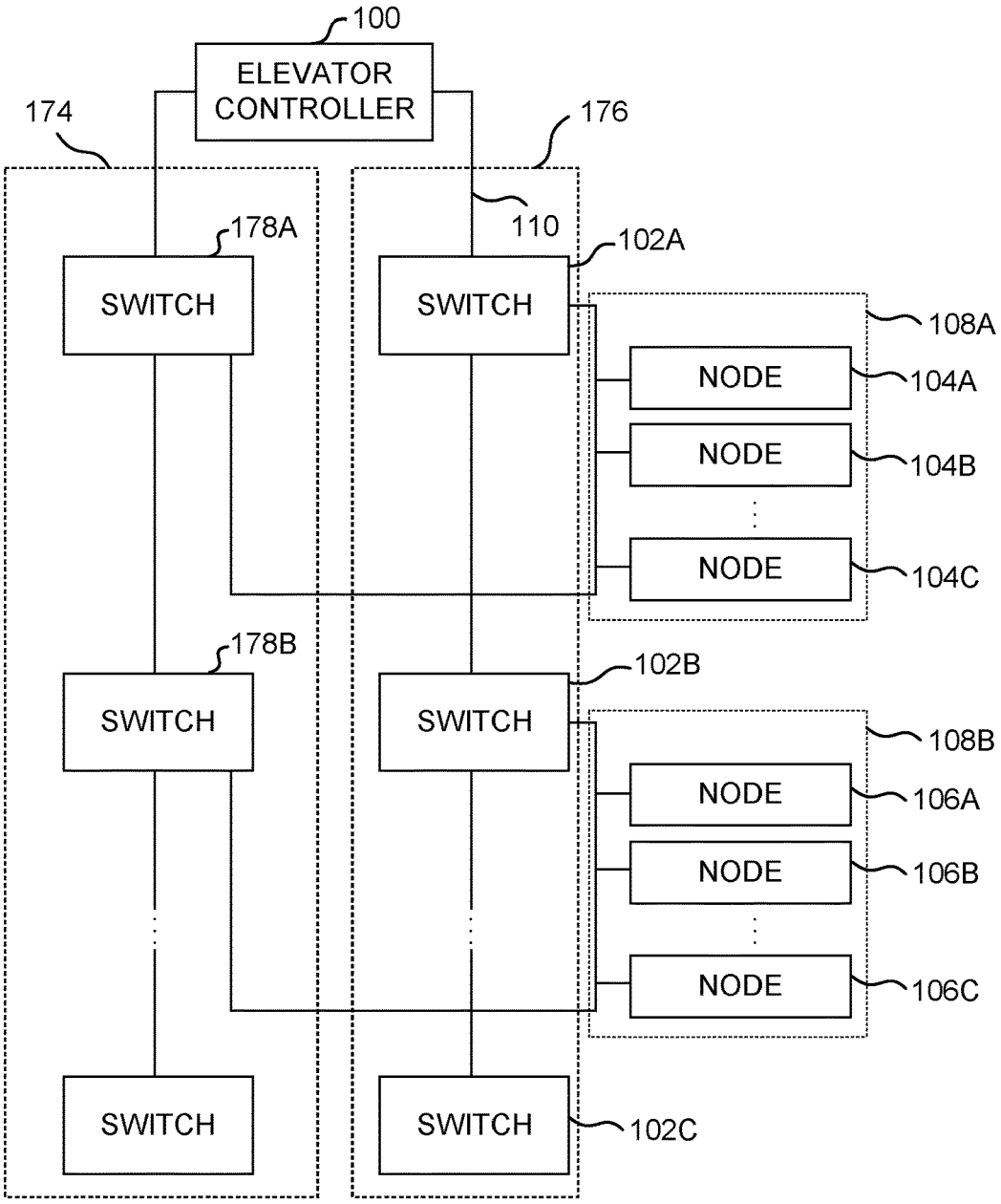
FIG. 1J illustrates an elevator communication system according to another example embodiment.

FIG. 1J illustrates an elevator communication system according to another example embodiment. The elevator communication system illustrated in FIG. 1J comprises the elevator communication system illustrated in FIG. 1A, and therefore, the elements of FIG. 1A are not discussed here again and reference is made to the description of FIG. 1A.

The elevator communication system of FIG. 1J comprises a parallel ethernet bus segment 174 interlinked with an ethernet bus segment 176 and extending in parallel with the ethernet bus segment 176. The elevator controller 100 is communicatively connected to the parallel ethernet bus segment 174.

The parallel ethernet bus segment 174 may be directly connected to the elevator controller 100. Additionally, or alternatively, one or more of the elevator system nodes, for example, a switch 178A, 178B may be connected to a multi-drop ethernet bus segment 108A, 108B.

In any of the embodiments and examples discussed above, the controller 100 may be configured to determine a fault situation in the elevator communication system and cause reduction of the data communication via any of the ethernet bus segments 110, 108A-108C, 122, 124A-124C, 134A, 134B, 136, 142A, 142B, 146, 152A-152C, 156, 158A-158C, 168A-168C based on the fault situation. There may be many sources of fault information in the elevator communication system. Elevator system nodes or specific network analyzers may gather information by measuring voltage levels, bandwidths, communication delays, disturbance etc. from the ethernet bus. For example, if a network analyzer or master, a safety controller etc. stops seeing an elevator system node or a specific frame, it can determine a communication system failure.

In an example embodiment, when a failure in the elevator communication system has been detected, a normal elevator operation or at least a degraded elevator operation may still be continued, thanks to the reduced communication available. The degraded elevator operation may mean, for example, operation of an elevator car with a reduced speed or in a limited area in an elevator shaft. For example, if a landing safety node/bus segment has failed, an elevator car travel to this landing may be prohibited. At the same time, a service request may be sent to a remote service center or a maintenance server to schedule a maintenance visit, such that full functionality of the elevator communication system will be restored. Because the elevator is still in use, the maintenance visit may be scheduled to hours causing least harm for the users, such as during night time, weekend etc.

In an example embodiment, the reduction may comprise reducing the amount of ethernet frames or data to be communicated via any of the ethernet bus segments 110, 108A-108C, 122, 124A-124C, 134A, 134B, 136, 142A, 142B, 146, 152A-152C, 156, 158A-158C, 168A-168C. This can be achieved, for example, by switching off one or more selected elevator system nodes or devices connected to the elevator system nodes. This enables a solution in which the bandwidth of the elevator communication system is available for important data to be communicated.

In an example embodiment, the reduction may comprise reducing the amount of ethernet frames communicated via any of the ethernet bus segments 110, 108A-108C, 122, 124A-124C, 134A, 134B, 136, 142A, 142B, 146, 152A-152C, 156, 158A-158C, 168A-168C based on a priority level associated with each ethernet frame. Messages communicated within the elevator communication system may be categorized into several priority levels, for example, into at least three different priority levels. In case of a communication failure in the elevator communication system, only messages of a selected priority level or levels are allowed to be communicated. The restriction of messages or data frames transmitted within the elevator communication system may be effected, for example, in a switch or switches of the elevator communication system.

In an example embodiment, messages or ethernet frames may be divided into priority levels, for example to at least the following three different priority levels:

- Priority level 1: This is the highest priority level and it may be reserved for safety messages, i.e. messages containing safety information for the elevator safety controller, such as status information of safety switches, safety actuators or other safety devices, or messages containing control commands for elevator safety actuators, (for example, for safety brakes, safety gear or corresponding).
- Priority level 2: This is the second-highest priority level and it may contain elevator control system communication. Such communication may be related to the operation of elevator control system, such as elevator drive device, elevator door operator, elevator call devices etc.
- Priority level 3: This is the lowest priority level and it may contain communication related to various devices or elevator system nodes, which may be easily disabled in case of a communication failure. Such devices may be, for example, elevator infotainment systems or entertainment systems, such as video displays representing additional information, advertisement etc. for elevator passengers.

The priority level may be coded into ethernet frames of the elevator communication system, for example, by using the user priority field as defined in IEEE 802.1Q. There may be more than the three priority levels discussed above in the elevator communication system, and further reduction of messaging is possible, for example, disabling one or more additional priority levels, depending on the severity of the particular failure.

In an example embodiment, the controller 100 may be configured to associate the communication in the elevator communication system into a plurality of communication profiles, and the controller 100 may be configured to cause reduction of the communication via any of the ethernet bus segments 110, 108A-108C, 122, 124A-124C, 134A, 134B, 136, 142A, 142B, 146, 152A-152C, 156, 158A-158C, 168A-168C by using the communication profiles.

The communication profiles may comprises one or more of the following, or additionally or alternatively one or more other profiles:

- A functional safety communication profile: This may be used for determining an elevator safety state. An elevator may be required to be brought into a safe state within one second or less, and therefore, this communication profile may have the highest priority and low or lowest latency.
- A control and I/O data communication profile: This communication profile may be used for elevator control operations, for example:
  - Reading call buttons, key switches and other user inputs
  - Providing visual of audible feedback to the user, showing elevator/call states etc.
  - Interfacing the discrete signals of the building, including call lock handling, fire protection doors etc.

Serving control functions, like car door control, including its I/O

Destination control panel (DOP) and display communication profile

An inter-group communication profile: This may provide communication between elevator groups. It may extend also between separate buildings etc.

An access control system communication profile: This may relate, for example, to communication with access gate systems, access door systems etc.

A diagnostics and remote maintenance communication profile: This may provide diagnostics communication to a remote maintenance server or cloud, remote maintenance center etc.

An audio and video streaming (high-priority) communication profile: This may contain high-priority real-time streaming of audio/video, such as alarm phone, as well as low-priority streaming, such as for entertainment display systems.

A communication profile between elevator control unit and elevator drive unit: This may be used to send control command to a drive unit. The drive unit will then provide control signals to an elevator motor to transfer passengers according to service requests.

Figure 2:
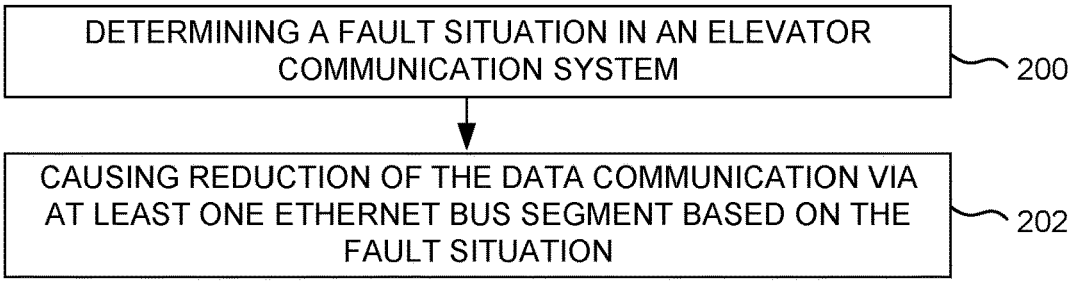
FIG. 2 illustrates a method in an elevator communication system according to an example embodiment.

FIG. 2 illustrates a method in an elevator communication system according to an example embodiment. The elevator communication system may any one of the elevator communication systems discussed above.

At 200, a fault situation is determined in the elevator communication system. The fault situation may be determined, for example, with a controller, an elevator controller, a network analyzer or master, a safety controller etc.

At 202, reduction of the data communication via the at least one ethernet bus segment is caused based on the fault situation. The reductions may be caused, for example, with the controller, elevator controller, network analyzer or master, safety controller etc.

Figure 3:
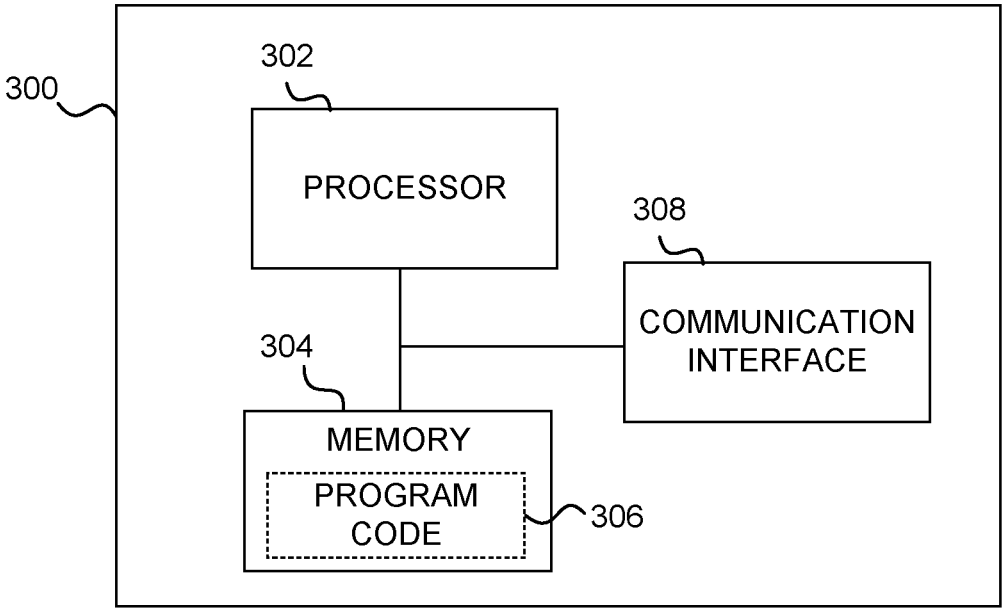
FIG. 3 illustrates a controller for controlling an elevator communication system according to an example embodiment.

FIG. 3 illustrates a controller 300 for controlling an elevator communication system according to an embodiment. The controller 300 may comprise at least one processor 302. The controller 300 may further comprise at least one memory 304. The memory 304 may comprise program code 306 which, when executed by the processor 302 causes the controller 300 to perform at least one example embodiment. The exemplary embodiments and aspects of the subject-matter can be included within any suitable device, for example, including, servers, elevator controllers, workstations, capable of performing the processes of the exemplary embodiments. The exemplary embodiments may also store information relating to various processes described herein. Although the controller 300 is illustrated as a single device it is appreciated that, wherever applicable, functions of the controller 300 may be distributed to a plurality of devices.

Example embodiments may be implemented in software, hardware, application logic or a combination of software, hardware and application logic. The example embodiments can store information relating to various methods described herein. This information can be stored in one or more memories 304, such as a hard disk, optical disk, magneto-optical disk, RAM, and the like. One or more databases can store the information used to implement the example embodiments. The databases can be organized using data structures (e.g., records, tables, arrays, fields, graphs, trees, lists, and the like) included in one or more memories or storage devices listed herein. The methods described with respect to the example embodiments can include appropriate data structures for storing data collected and/or generated by the methods of the devices and subsystems of the example embodiments in one or more databases.

The processor 302 may comprise one or more general purpose processors, microprocessors, digital signal processors, micro-controllers, and the like, programmed according to the teachings of the example embodiments, as will be appreciated by those skilled in the computer and/or software art(s). Appropriate software can be readily prepared by programmers of ordinary skill based on the teachings of the example embodiments, as will be appreciated by those skilled in the software art. In addition, the example embodiments may be implemented by the preparation of application-specific integrated circuits or by interconnecting an appropriate network of conventional component circuits, as will be appreciated by those skilled in the electrical art(s). Thus, the examples are not limited to any specific combination of hardware and/or software. Stored on any one or on a combination of computer readable media, the examples can include software for controlling the components of the example embodiments, for driving the components of the example embodiments, for enabling the components of the example embodiments to interact with a human user, and the like. Such computer readable media further can include a computer program for performing all or a portion (if processing is distributed) of the processing performed in implementing the example embodiments. Computer code devices of the examples may include any suitable interpretable or executable code mechanism, including but not limited to scripts, interpretable programs, dynamic link libraries (DLLs), Java classes and applets, complete executable programs, and the like.

As stated above, the components of the example embodiments may include computer readable medium or memories 304 for holding instructions programmed according to the teachings and for holding data structures, tables, records, and/or other data described herein. In an example embodiment, the application logic, software or an instruction set is maintained on any one of various conventional computer-readable media. In the context of this document, a "computer-readable medium" may be any media or means that can contain, store, communicate, propagate or transport the instructions for use by or in connection with an instruction execution system, apparatus, or device, such as a computer. A computer-readable medium may include a computer-readable storage medium that may be any media or means that can contain or store the instructions for use by or in connection with an instruction execution system, apparatus, or device, such as a computer. A computer readable medium can include any suitable medium that participates in providing instructions to a processor for execution. Such a medium can take many forms, including but not limited to, non-volatile media, volatile media, transmission media, and the like.

The controller 300 may comprise a communication interface 308 configured to enable the controller 300 to transmit and/or receive information, to/from other apparatuses.

The controller 300 comprises means for performing at least one method described herein. In one example, the means may comprise the at least one processor 302, the at least one memory 304 including program code 306 configured to, when executed by the at least one processor 302, cause the controller 300 to perform the method.

At least some of the above discussed example embodiments may enable transmission of any device data seamlessly between elevator system devices and any other device or system. At least some of the above discussed example embodiments may also enable a solution that provides improved reliability and availability of an all-ethernet elevator communication system. Further, elevator service does not have to be interrupted in case of a single failure in the elevator communication system. At least some of the above discussed example embodiments may also enable a solution in which data may be transmitted in the elevator communication system in a controlled manner by allowing only certain data to be transmitted in case of a failure in the elevator communication system.

While there have been shown and described and pointed out fundamental novel features as applied to preferred embodiments thereof, it will be understood that various omissions and substitutions and changes in the form and details of the devices and methods described may be made by those skilled in the art without departing from the spirit of the disclosure. For example, it is expressly intended that all combinations of those elements and/or method steps which perform substantially the same function in substantially the same way to achieve the same results are within the scope of the disclosure. Moreover, it should be recognized that structures and/or elements and/or method steps shown and/or described in connection with any disclosed form or embodiments may be incorporated in any other disclosed or described or suggested form or embodiment as a general matter of design choice.

The applicant hereby discloses in isolation each individual feature described herein and any combination of two or more such features, to the extent that such features or combinations are capable of being carried out based on the present specification as a whole, in the light of the common general knowledge of a person skilled in the art, irrespective of whether such features or combinations of features solve any problems disclosed herein, and without limitation to the scope of the claims. The applicant indicates that the disclosed aspects/embodiments may consist of any such individual feature or combination of features. In view of the foregoing description it will be evident to a person skilled in the art that various modifications may be made within the scope of the disclosure.

The invention claimed is:

1. An elevator communication system, comprising:

at least one ethernet bus segment;

a controller communicatively connected to the at least one ethernet bus segment; and a plurality of elevator system nodes communicatively connected to the at least one ethernet bus segment, wherein the controller is configured to determine a fault situation in the elevator communication system and cause reduction of the data communication via the at least one ethernet bus segment based on the fault situation, and wherein the reduction comprises reducing the amount of ethernet frames communicated via the at least one ethernet bus segment.

2. The elevator communication system of claim 1, wherein the reduction comprises reducing the amount of ethernet frames communicated via the at least one ethernet bus segment based on a priority level associated with each ethernet frame.

3. The elevator communication system of claim 1, wherein the controller is configured to switch off at least one of the plurality of elevator system nodes to cause the reduction of the data communication via the at least one ethernet bus segment.

4. The elevator communication system of claim 1, wherein the controller is configured to associate communication in the elevator communication system into a plurality of communication profiles, and wherein the controller is configured to cause reduction of the communication via the at least one ethernet bus segment based on the communication profiles.

5. The elevator communication system of claim 1, wherein the elevator communication system comprises a parallel ethernet bus segment interlinked with the at least one ethernet bus segment and extending in parallel with the at least one ethernet bus segment; and wherein the controller is communicatively connected to the parallel ethernet bus segment.

6. The elevator communication system of claim 1, wherein the at least one ethernet bus segment comprises at least one multi-drop ethernet segment.

7. The elevator communication system of claim 1, wherein the controller comprises an elevator controller.

8. The elevator communication system of claim 1, wherein the controller is configured to associate communication in the elevator communication system into a plurality of communication profiles, and wherein the controller is configured to cause reduction of the communication via the at least one ethernet bus segment based on the communication profiles.

9. An elevator communication system, comprising:

at least one ethernet bus segment;

a controller communicatively connected to the at least one ethernet bus segment; and a plurality of elevator system nodes communicatively connected to the at least one ethernet bus segment, wherein the controller is configured to determine a fault situation in the elevator communication system and cause reduction of the data communication via the at least one ethernet bus segment based on the fault situation, wherein the controller is configured to operate an elevator car with a limited speed in response to the determination, or wherein the controller is configured to operate an elevator car in a limited area in an elevator shaft in response to the determination.

10. An elevator communication system, comprising:

at least one ethernet bus segment;

a controller communicatively connected to the at least one ethernet bus segment; and a plurality of elevator system nodes communicatively connected to the at least one ethernet bus segment, wherein the controller is configured to determine a fault situation in the elevator communication system and cause reduction of the data communication via the at least one ethernet bus segment based on the fault situation, and wherein the at least one ethernet bus segment comprises at least one point-to-point ethernet segment.

11. A method in an elevator communication system comprising at least one ethernet bus segment, a controller communicatively connected to the at least one ethernet bus segment, and a plurality of elevator system nodes communicatively connected to the at least one ethernet bus segment, the method comprising:

determining, by the controller, a fault situation in the elevator communication system; and causing, by the controller, reduction of the data communication via the at least one ethernet bus segment based on the fault situation, wherein the reduction comprises reducing the amount of ethernet frames communicated via the at least one ethernet bus segment.

12. The method of claim 11, wherein the reduction comprises reducing the amount of ethernet frames communicated via the at least one ethernet bus segment based on a priority level associated with each ethernet frame.

13. The method of claim 11, further comprising:

switching off, by the controller, at least one of the plurality of elevator system nodes to cause the reduction of the data communication via the at least one ethernet bus segment.

14. The method system of claim 11, further comprising:

associating, by the controller, communication in the elevator communication system into a plurality of communication profiles; and causing, by the controller, the reduction of the communication via the at least one ethernet bus segment based on the communication profiles.

15. A method in an elevator communication system comprising at least one ethernet bus segment, a controller communicatively connected to the at least one ethernet bus segment, and a plurality of elevator system nodes communicatively connected to the at least one ethernet bus segment, the method comprising:

determining, by the controller, a fault situation in the elevator communication system;

causing, by the controller, reduction of the data communication via the at least one ethernet bus segment based on the fault situation, and operating, by the controller, an elevator car with a limited speed in response to the determination, or operating, by the controller, an elevator car in a limited area in an elevator shaft in response to the determination.

16. A controller communicatively connected to at least one ethernet bus segment, the controller being configured to:

determine a fault situation in an elevator communication system comprising the at least one ethernet bus segment, and a plurality of elevator system nodes communicatively connected to the at least one ethernet bus segment; and cause reduction of the data communication via at least one ethernet bus segment of the elevator communication system based on the fault situation, wherein the reduction comprises reducing the amount of ethernet frames communicated via the at least one ethernet bus segment.

* * * * *